US005114389A

United States Patent [19]

Brentham, Jerry D.

[11] Patent Number: 5,114,389

[45] Date of Patent: May 19, 1992

[54] STAIR CLIMBER EXERCISE DEVICE

[76] Inventor: Brentham, Jerry D., 2121 Industrial Park Rd., Belton, Tex. 76513

[21] Appl. No.: 593,339

[22] Filed: Oct. 1, 1990

Related U.S. Application Data

[63] Continuation of Ser. No. 371,333, Jun. 23, 1989, abandoned.

[51] Int. Cl.[5] ..... A63B 23/04

[52] U.S. Cl. ..... 482/53; 482/113

[58] Field of Search ..... 272/69, 70, 71, 72, 272/73, 96, 97, 129, 130

[56] References Cited

U.S. PATENT DOCUMENTS

| | | | |
|---|---|---|---|
| 3,628,791 | 12/1971 | Garcia | 272/70 |
| 3,747,924 | 7/1973 | Champoux | 272/70 |
| 3,970,302 | 7/1976 | McFee | 272/130 |
| 4,226,415 | 10/1980 | Wright | 272/130 |
| 4,291,787 | 9/1981 | Brentham . | |
| 4,566,692 | 1/1986 | Brentham | 272/130 |
| 4,645,200 | 2/1987 | Hix | 272/70 X |
| 4,667,955 | 5/1987 | Giesch | 272/130 |
| 4,676,501 | 6/1987 | Hoagland et al. | 272/70 |
| 4,681,316 | 7/1987 | DeCloux | 272/130 |
| 4,705,028 | 11/1987 | Melby | 272/70 X |
| 4,708,338 | 11/1987 | Potts | 272/70 |
| 4,733,858 | 3/1988 | Lan | 272/130 X |
| 4,830,362 | 5/1989 | Bull | 272/70 |
| 4,838,543 | 6/1989 | Armstrong et al. | 272/70 |

FOREIGN PATENT DOCUMENTS

| | | | |
|---|---|---|---|
| 2416778 | 10/1974 | Fed. Rep. of Germany | 272/70 |

*Primary Examiner*—Robert Bahr

*Attorney, Agent, or Firm*—Crutsinger & Booth

[57] ABSTRACT

A leg exercising device including a frame, a pair of pedal arms pivotally secured to the frame, a double acting hydraulic cylinder having a chamber and a piston movably disposed therein, and a pair of valves connected to the hydraulic cylinder for controlling flow of fluid to and from the chamber on opposite sides of the piston. Foot engaging straps on the pedals exert a force in opposite directions toward and away from each pedal as a result of movement of the foot of a user in opposite directions. The valves are mounted adjacent the pedal within the reach of the user whose foot is in engagement with the foot engaging straps to permit independent adjustment of the magnitude of force resisting movement of the pedal arms in opposite directions.

13 Claims, 11 Drawing Sheets

PARALLEL INTERFACE
TO EXTERNAL COMPUTER
TRISTATE OCTAL LINE DRIVER
A/D CONV.
A/D CONV.
TO PRES. TRANS.
TO PRES. TRANS.
COUNTER
OSC
+5
+12
VREF
J3

FORCE D1
POWER D2
WORK D3
A. WORK D0
T. POWER D1
FORCE D1
POWER D2
WORK D3
RECALL D0
A. WORK D0
T. POWER D1
EXTRA D2
CAL D3
TO SWITCHES
LEFT D0
RIGHT D1
EXTENTION D0
FLEXION D1
TO SWITCHES
EXTENTION
FLEXION
LEFT
RIGHT
RESET D2 OR D3

STAIR CLIMBER EXERCISE DEVICE

This is a continuation of application Ser. No. 07/371,333 filed June 23, 1989, now abandoned.

TECHNICAL FIELD

The disclosure relates to an exercising device incorporating a pair of reciprocating pedals which oscillate as a user transfers force from one pedal to the other to simulate climbing stairs. A toe strap on each pedal permits the apparatus to be used for both extension and flexural exercises.

BACKGROUND OF INVENTION

The present invention relates to improvements in exercising devices of the general type disclosed in U.S. Pat. No. 4,830,362 and U.S. Pat. No. 4,708,338 wherein the weight of a user is shifted between two pedals to simulate climbing stairs. A hydraulic cylinder having a needle valve in a line between opposite ends of the cylinder resists movement of pedals disclosed in Pat. No. 4,830,362. Force L required for moving the pedals disclosed in Pat. No. 4,708,338 is resisted by an electrical alternator or generator driven through a series of chains and sprockets for dissipating work done by a user.

Climber type exercising devices are commercially available from several manufacturers which incorporate dual single acting hydraulic or pneumatic cylinders having pistons which reciprocate upon movement of spaced pedals. The spaced pedals are connected by a rope or cable extending around a pulley such that a downward force exerted on one pedal is transmitted through the rope or cable for applying an upward force to elevate the other pedal. Hydraulic or pneumatic cylinders are pivotally connected to slides movable along the length of the pedals for adjusting the point at which each pneumatic cylinder is secured to each pedal to adjust the mechanical advantage and consequently force required to move each pedal. Each single action cylinder is independent of the other and the cable or rope pulls one pedal up when the other is pushed down.

Still another type of climber which is commercially available incorporates two hydraulic cylinders in which the base of one of the cylinders is connected through a hydraulic line to the rod end of the other cylinder such that a downward force on one pedal forces hydraulic fluid into the other cylinder for elevating the other pedal.

Difficulty has been encountered with hydraulic systems in some of the climber exercise devices because hydraulic fluid bypasses piston seals causing the stroke of the pedals to be progressively reduced and requiring the user of the apparatus to stop and readjust the hydraulic system.

Climbing type exercising devices heretofore developed have been unduly complicated and has not been adapted to expeditiously change force required for moving the pedals without manipulation of elaborate structural relationships of the components. Physical conditioning equipment for athletic teams and physical education classes for students often require use of a single piece of equipment by several different users of different body size and strength in a short time interval. Further, during warm-up for exercises, less resistance may be desirable than during a subsequent more strenuous phase of the exercise session.

SUMMARY OF INVENTION

The stair climber exercise device disclosed herein includes a pair of pedals equipped with a toe strap which reciprocate about a shaft in which a single double acting hydraulic cylinder controls movement of each pedal for both extension and flexion exercises. Force required for moving each pedal is adjustable through a hydraulic control valve accessible to the user without stopping use of the equipment. In a first embodiment of the invention forces required to move each pedal in each direction are equal. However, in a second embodiment a pair of control valves permits variation in forces required to raise and lower one of the pedals to provide different prescribed resistances for extension and flexion exercise of a limb for rehabilitation and therapy.

The pedal arms are synchronized by a rocker arm and a pair of connecting rods secured to the pedal arms such that movement of one pedal in one direction exerts force through the connecting rods and rocker arm for moving the other pedal in the opposite direction. The rigid rocker arm and connecting rods cause the pedals to move synchronously.

The exercise device may be used to simulate stair climbing by positioning the pedal arms substantially horizontally while the user stands with one foot on the end of each pedal and shifts his weight from one foot to the other. The stroke of the pedals is determined by the rate at which the user shifts his weight from one foot to the other.

The exercising device may be used for performing other exercises by orienting the device such that the pedal arms extend substantially vertically allowing the user to exert force in a substantially horizontal direction for performing exercises such as the "leg press".

The pedals are provided with force applying apparatus, such as a boot or toe strap, which permits application of force to each lever in directions both toward and away from the lever, permitting use of the apparatus by a user for performing extensive exercises on one leg and flexure exercises on the other leg at the same time. In certain therapy and rehabilitation programs, only one leg may be used or one leg may be used to a greater degree than the other for performing exercises. For example, while performing "leg press" exercises, the user may pull with one leg while pushing with the other for moving the pedals.

A primary object of the invention is to provide an exercising device in which force required for moving the pedals is easily and quickly adjusted by a user without stopping an exercise, in which pedals are connected by a solid linkage to maintain a pre-established relationship of movement between the pedals.

DESCRIPTION OF DRAWINGS

Drawings of a preferred embodiment of the stair climber exercise device are annexed hereto so that the invention may be better and more fully understood, in which.

Numeral references are employed to designate like parts throughout the various figures of the drawing.

DESCRIPTION OF A PREFERRED EMBODIMENT

Figure 2:
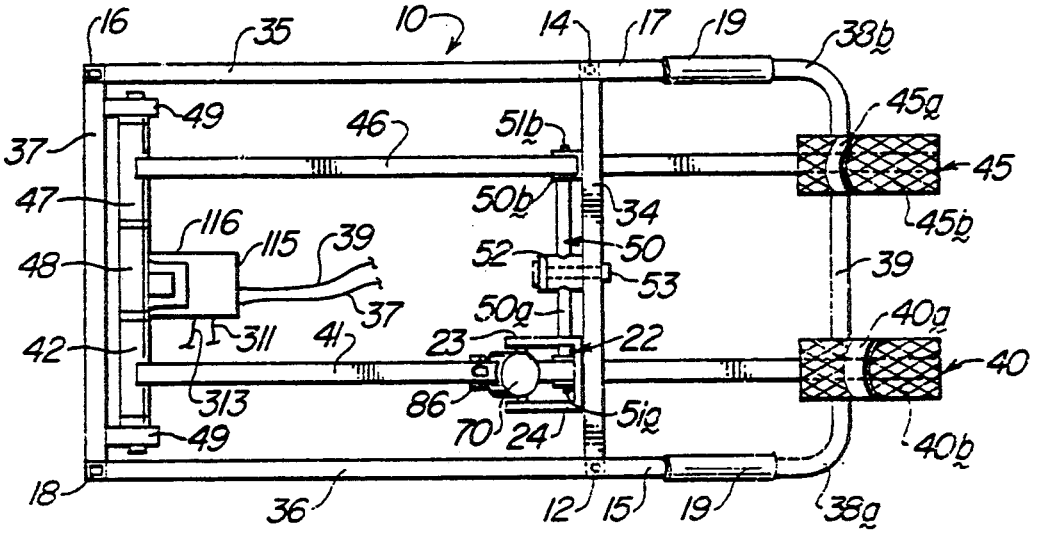
FIG. 2 is a top plan view.

The numeral 10 generally designates a stair climber exercise device which includes a pair of pedals 40 and 45 pivotally secured to a shaft 48. Rigid connecting rods 56 and 58 are pivotally secured to opposite ends of a rocker arm 50 for transmitting a force to one pedal which is opposite in direction and of lesser magnitude than the magnitude of force applied to the end of the other pedal. A double acting hydraulic cylinder 70 of the type disclosed in U.S. Pat. No. 4,291,787 which issued Sept. 29, 1981 or U.S. Pat. No. 4,566,692 which issued Jan. 28, 1986 to Jerry D. Brentham applies a variable resistance to movement of pedals 40 and 45 as will be hereinafter more fully explained.

Figure 1:
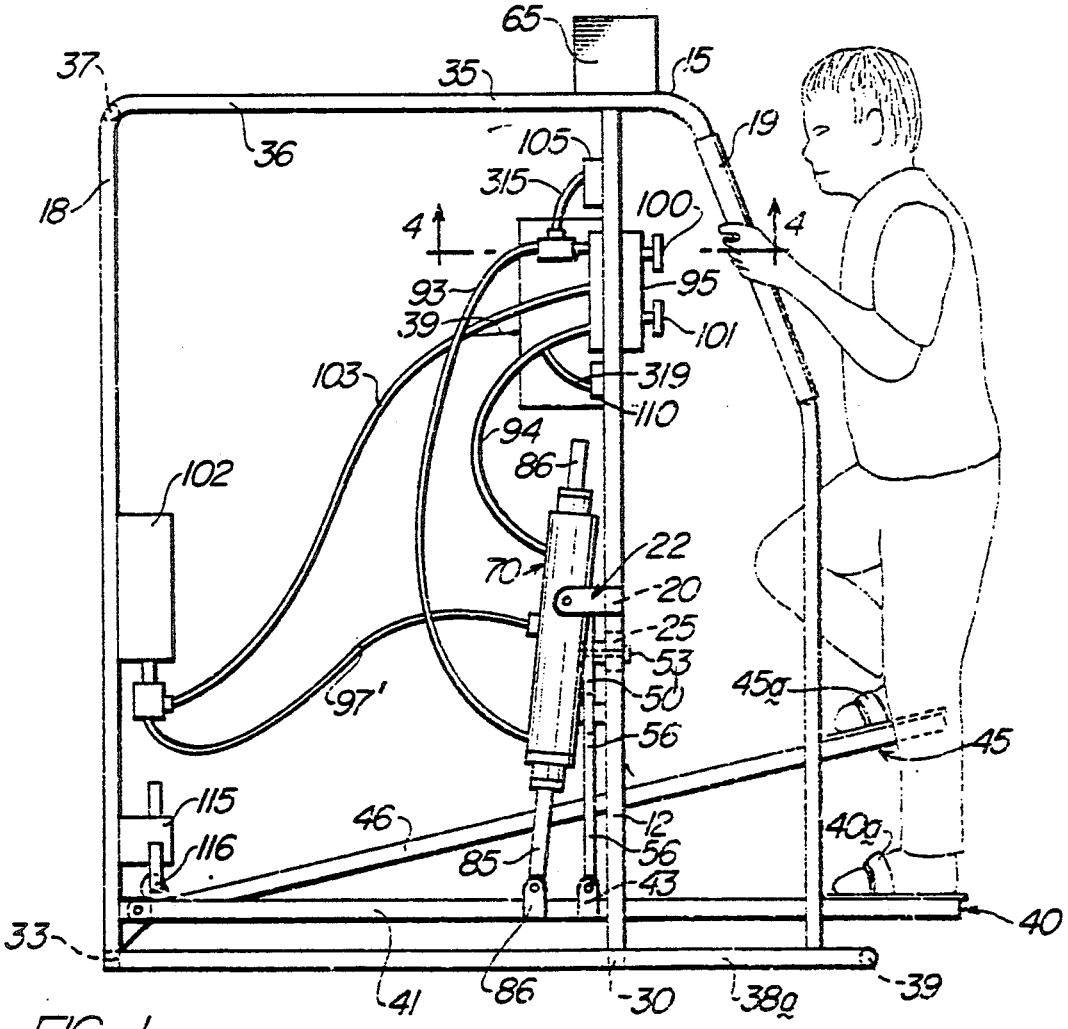
FIG. 1 is a side elevational view, parts being broken away to more clearly illustrate details of construction.

Referring to FIGS. 1 and 2 of the drawing, the frame of the exercise device generally comprises spaced posts 12, 14, 16 and 18, which in the illustrated embodiment extend substantially vertically, having lower ends connected by lower sills 30, 31, 32 and 33 and having upper ends connected by upper sills 34, 35, 36 and 37.

Figure 3:
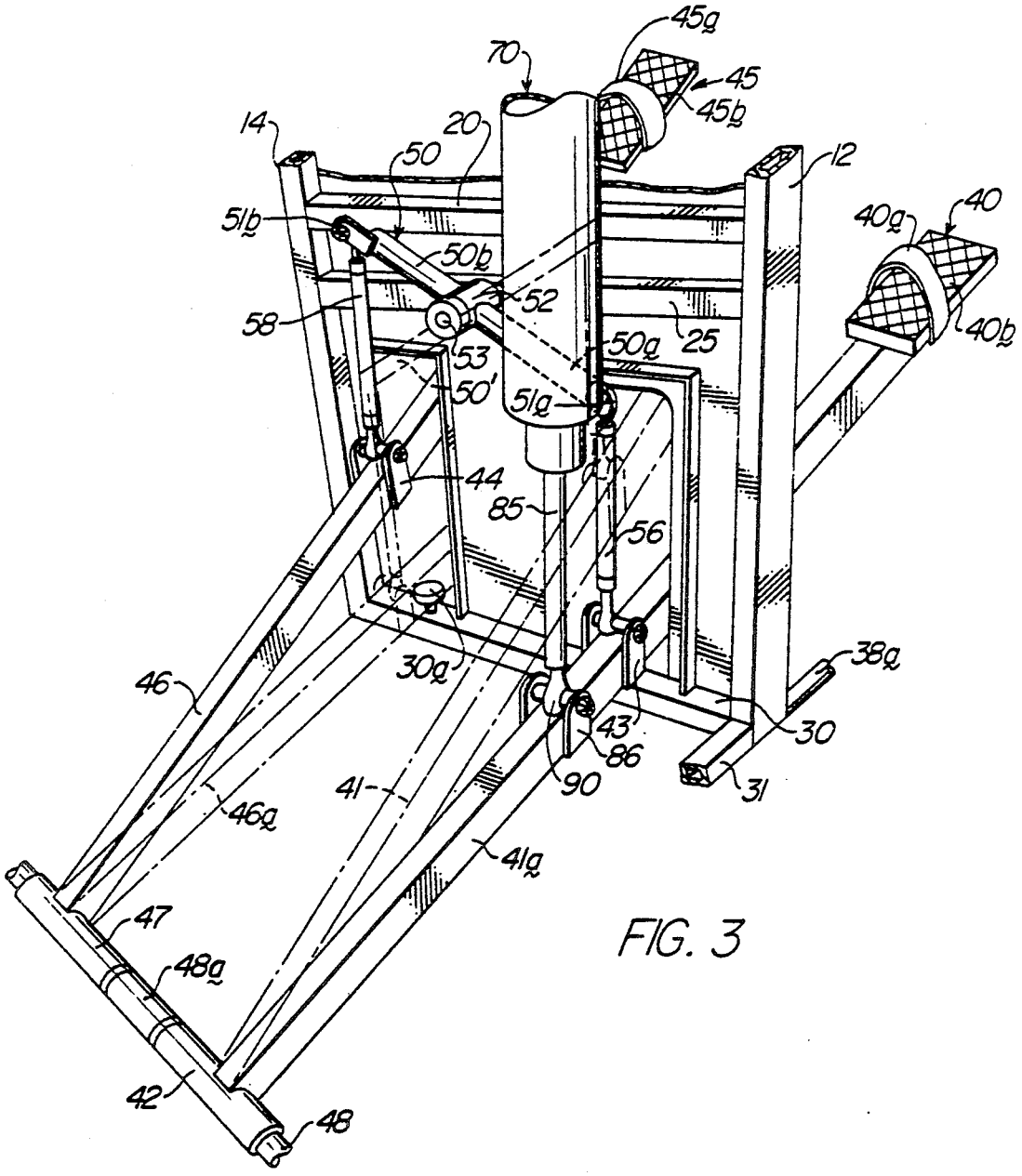
FIG. 3 is a fragmentary perspective view.

As best illustrated in FIG. 3 of the drawing, cross beams 20 and 25 extend between posts 12 and 14 for supporting rocker arm 50 and double acting hydraulic cylinder 70. As will be hereinafter more fully explained, a channel shaped bracket 22 having spaced ears 23 and 24 is secured to beam 20 for pivotally securing hydraulic cylinder 70 to the frame.

A pair of extension members **38*a* and 38*b* and a cross brace section 39 extending across the front of the exercising device are formed by a bent tube welded or otherwise secured to front lower cross sill 30, as illustrated in FIGS. 1 and 2 of the drawing. Hand rails 15 and 17 have lower ends welded or otherwise secured to extension members 38*a* and 38*b* and upper ends secured to upper ends of posts 12 and 14. Hand grips 19 are provided on each hand rail 15 and 17**.

As best illustrated in FIGS. 2 and 3 of the drawing, rocker arm 50 comprises two oppositely extending legs **50*a* and 50*b* welded or otherwise secured to a central hub 52 rotatably mounted on a pivot pin 53 secured to cross beam 25 of the frame. Clevises 51*a* and 51*b* are formed on outer extremities of legs 50*a* and 50*b*, respectively, and pivotally support connecting rods 56 and 58. Connecting rods 56 and 58 are preferably rigid rod members capable of carrying both tension and compression loading and have rod eyes formed on opposite ends thereof. Connecting rods 56 and 58 are pivotally secured to the clevises 51*a* and 51*b* on rocker arm 50 by a bolt or pivot pin. The opposite ends of connecting rods 56 and 58 are pivotally connected between spaced ears 43 and 44 secured to pedals 40 and 45**.

The pedal generally designated by the numeral 40 in FIG. 3 of the drawing comprises a pedal arm 41 having one end welded or otherwise secured to a bearing sleeve 42 mounted for arcuate movement about a shaft 48. Pedal 45 includes a pedal arm 46 welded or otherwise secured to a bearing sleeve 47 mounted for rotational movement about shaft 48. A spacer tube **48*a* is mounted on shaft 48 between bearing sleeves 42 and 47. Opposite ends of shaft 48 are supported in passages formed in lugs 49 welded or otherwise secured between rear posts 16 and 18 to bottom rear sill 33**.

Referring to FIGS. 1 and 3 of the drawing, a user positions one foot on pedal 40 and another foot on pedal 45. When the weight of the user is applied to pedal 45, pedal 45 rotates about shaft 48. Connecting rod 58 applies a downwardly directed force to leg **50*b* of rocker arm 50 which rotates about pivot pin 53 causing end 50*a* of rocker arm 50 to move upwardly. Upward movement of end 50*a* of rocker arm 50 transfers an upwardly directed force through connecting rod 56 to pedal 40 which also exerts an upwardly directed force on the piston rod of hydraulic cylinder 60. The rate of downward movement of pedal 45 and upward movement of pedal 40 is controlled by hydraulic cylinder 60**.

Pedal arms 41 and 46 move between the full line position illustrated in FIG. 3 of the drawing to the dashed outline position designated **41*a* and 46*a*. It should be readily apparent that when the weight of the user is shifted from pedal 45 to pedal 40, force is applied through pedal arm 41 to extend piston rod 85 and force is applied through connecting rod 56, rocker arm 50 and connecting rod 58 for applying an upwardly directed force to pedal 45. Stop screws 30*a* are threadedly secured in apertures form in front sill 30 to limit the range of the stroke of pedals 40 and 45**.

Rocker arm 50 and connecting rods 56 and 58 are arranged for transmitting a vertical force to pedal arm 46 which is opposite in direction and of lesser magnitude than force applied to the end 45 of pedal arm 41 since the double acting hydraulic cylinder applies force resisting movement of both pedal 40 and pedal 45.

Each pedal 40 and 45 is equipped with a toe strap **40*a* and 45*a* which extends over the arch of the foot of a user when the sole of the foot of the user is resting on plate 40*b* and plate 45*b*. Thus, it should be readily apparent that straps 40*a* and 45*a* permit a user to push downwardly on pedal 45 while pulling upwardly on pedal 40** to simultaneously perform extensive exercise on one leg and flexure exercises on the other.

Figure 14:
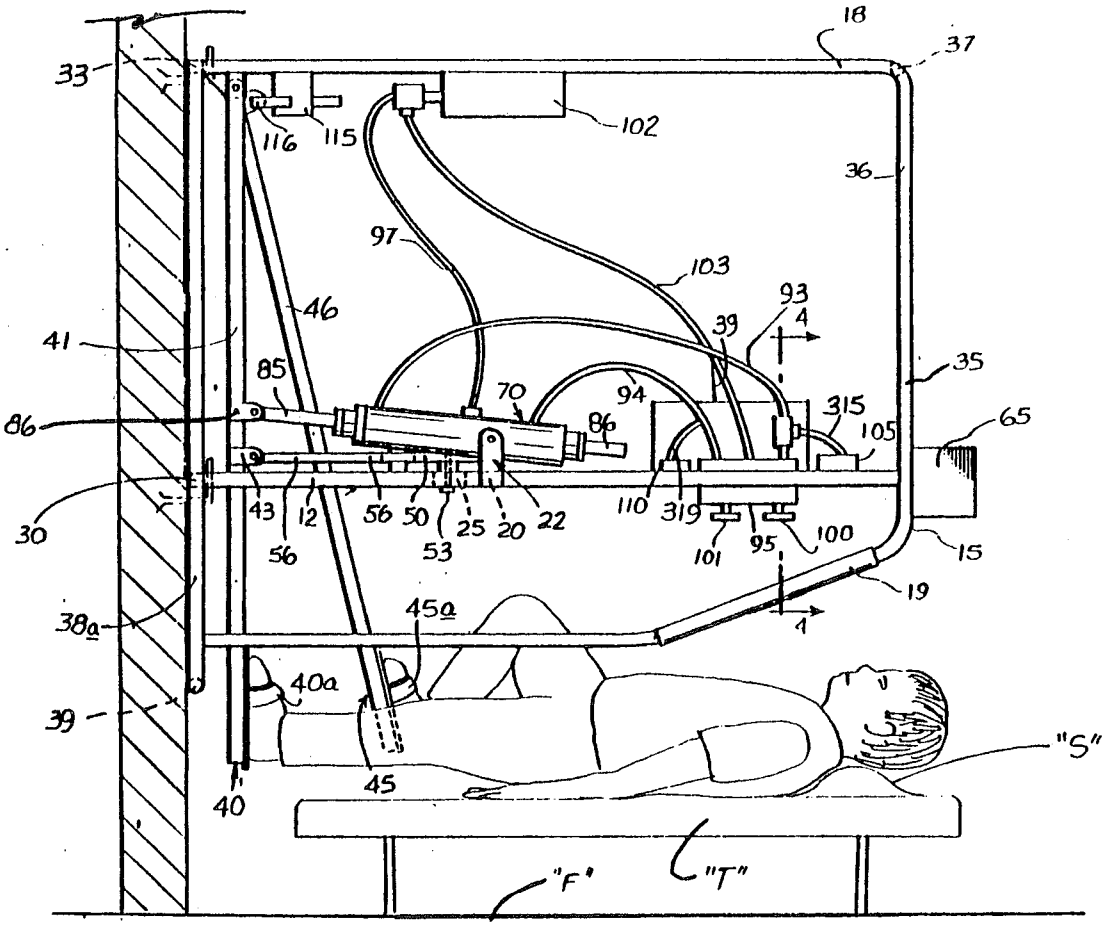
FIG. 14 is a side elevational view similar to FIG. 1 wherein the apparatus is positioned for performing "leg press" exercises.

While the frame and pedal arrangement hereinbefore described and illustrated in FIGS. 1–3 of the drawing is oriented for use for stair climbing exercises, it should be appreciated that the device may be rotated through 90 from the position illustrated in FIG. 1 of the drawing such that sill 31 is positioned vertically and post 18 extends horizontally for use of the structure for performing leg press exercises, as illustrated in FIG. 14. The user would lie on his back on a mat on the floor "F" or on a table "T" while exerting force in a generally horizontal direction against pedals 40 and 45. Shoulder pads "S" or other restraining devices (not shown) would preferably be employed for stabilizing the user as force is exerted on pedals 40 and 45.

A double acting hydraulic cylinder 70 of the type disclosed in U.S. Pat. No. 4,566,692 or of the type disclosed in U.S. Pat. No. 4,291,787 is used to resist movement of pedal arm 41 when moved by the user. The disclosure of Pat. No. 4,566,692 and U.S. Pat. No. 4,291,787 are incorporated herein by reference in their entirety for all purposes. Hydraulic cylinder 70 is pivotally attached between ears 23 and 24 of channel bracket 22 on cross beam 20 of the frame and piston rod 82 is pivotally fastened to pedal arm 41.

Turning now to FIG. 1 double acting hydraulic cylinder 70 is shown with pedal arm 41 being moved upwardly from the full outline position illustrated in FIG. 3 toward the position illustrated in dashed outline. Thus a downwardly directed force on pedal 45 results in an upwardly directed force being applied through connecting rods 58 and 56 and rocker arm 50 to pedal arm 41 to urge piston rod 85 into cylinder 70.

Figure 6:
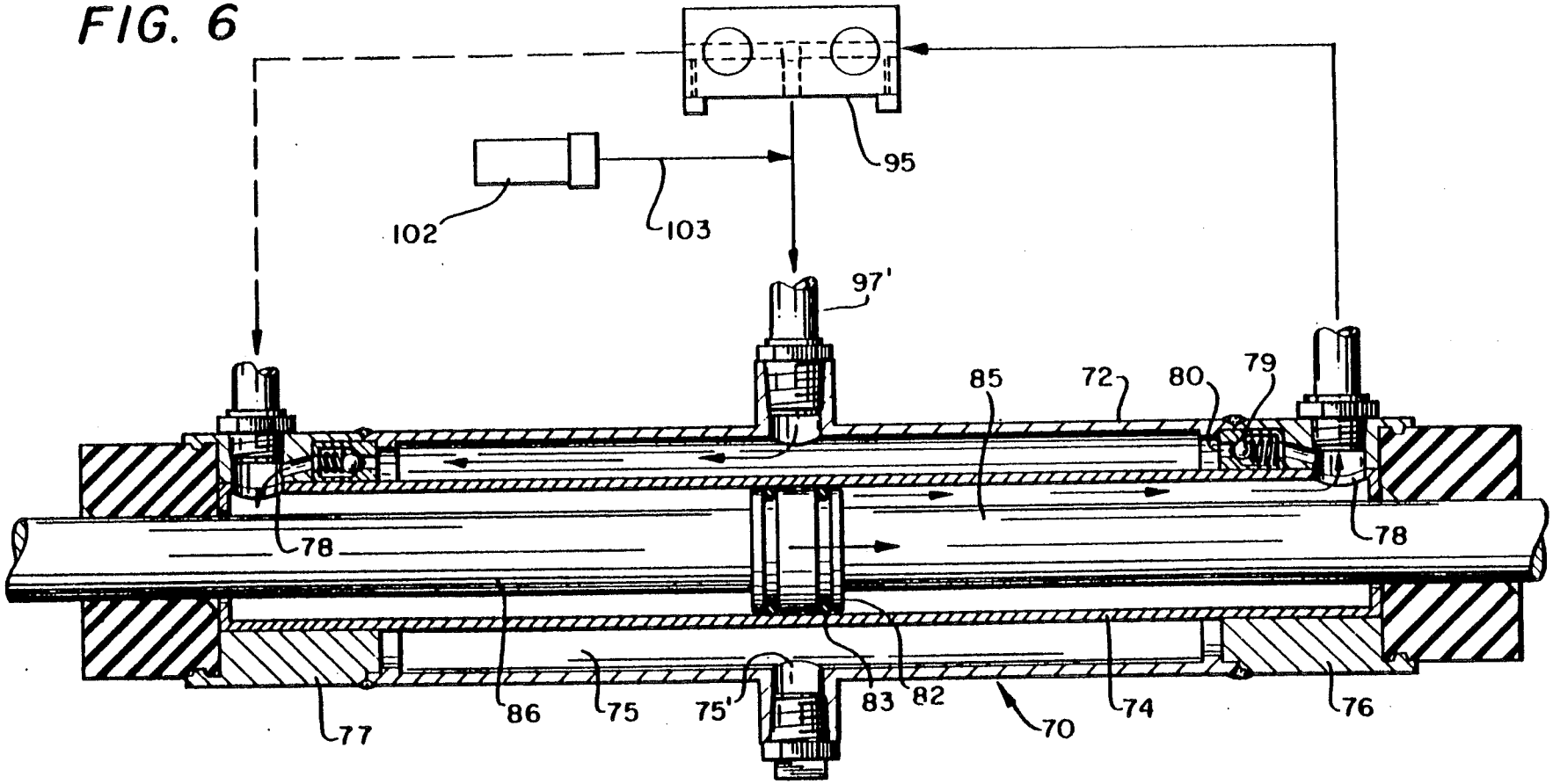
FIG. 6 is an enlarged partially sectionalized view of the hydraulic cylinder.
Figure 7:
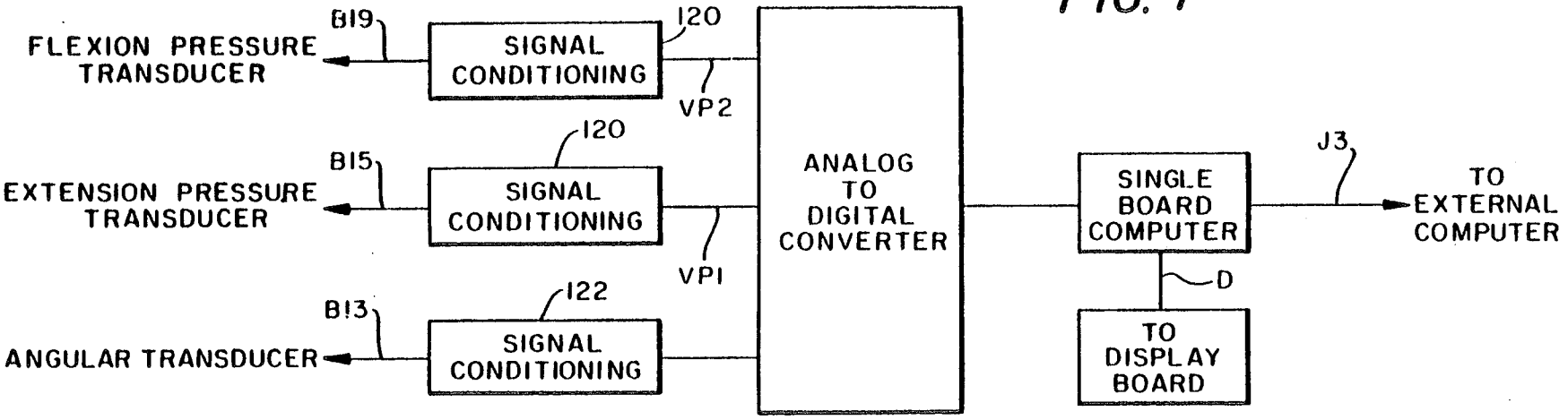
FIG. 7 is a block diagram of the microprocessor circuit.

Movement of pedal actuating arm 41 about pivot shaft 48 is resisted by a double acting hydraulic cylinder 70, which as best illustrated in FIG. 6 of the drawing, comprises a cylindrical tubular member 72 having a cylinder housing 74 extending axially therethrough for forming a reservoir 75 in the annulus between cylindrical members 72 and 74. End plugs or cylinder caps 76 and 77 are of identical construction and each is provided with a threaded passage 78 which extends through member 72, 74 and 76 for connecting a hydraulic line in fluid communication with the inside of cylinder 74 as will hereinafter be more fully explained. Plug members 74 are provided with spring loaded check valves 79 in ports 80 which extend between the reservoir in the annulus 75 and passage 78 to permit substantially unrestricted flow of fluid from reservoir 75 into passages 78 but blocking flow of fluid from passage 78 through port 80 into the reservoir 75.

A piston 82 having seal rings 83 mounted thereon is slidably disposed through cylinder 74 and has rods 85 and 86 extending through passages formed in cylinder caps 76 and 77. Thus, when rod 85 is extended, rod 86 is retracted.

Referring to FIG. 3, rod 85 has a rod eye 90 on the outer end thereof pivotally secured by a pin 92 to lugs on a central portion of actuating arm 41. Cylinder 70 is pivotally secured by pins 71 to cylinder support bar 40. Rod 86 on the opposite end of the cylinder is preferably provided with a stop **86*a* to limit movement of piston 82 to selectively limit the range of angular movement of arm 41**.

As best illustrated in FIG. 3 of the drawing, opposite ends of cylinder 70 are connected through lines 93 and 94 to a control valve 95.

Figure 4:
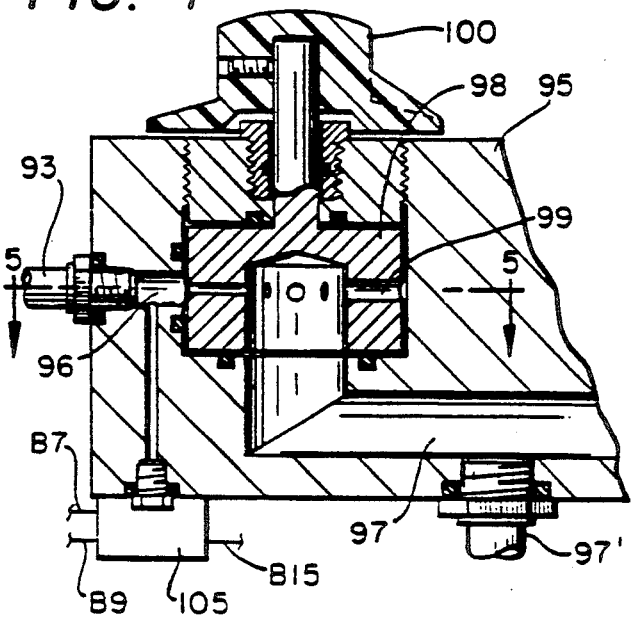
FIG. 4 is a cross sectional view taken along line 4—4 of FIG. 1.
Figure 5:
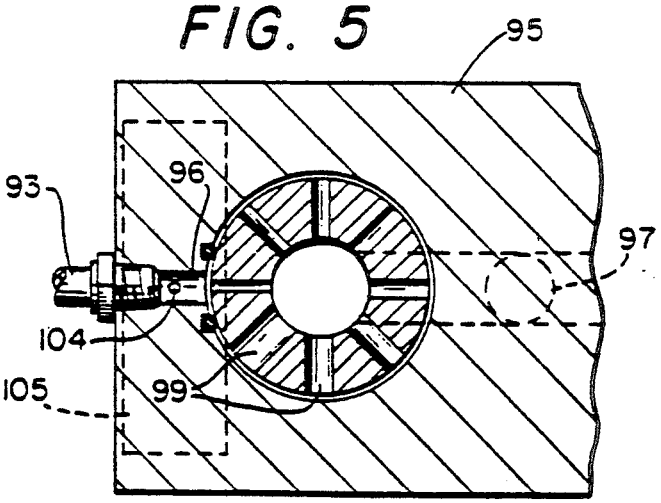
FIG. 5 is a cross sectional view taken along line 5—5 of FIG. 4.

As illustrated in FIG. 4 of the drawing, valve body 95 has a valve element 98 rotatably secured in a chamber communicating with inlet passage 96 and with an outlet passage 97. Valve element 98 has a plurality of metering orifices of varying diameter for placing inlet passage 96 in fluid communication with outlet passage 97. Valve element 98 is rotated to a desired position by rotation of a knob 100 accessible from the console between pedals 40 and 45 of exercising device 10. A second knob 101 is positioned for controlling a second valve element to adjust flow through line 94 from the opposite end of double acting hydraulic cylinder 70. As best illustrated in FIG. 5 of the drawing, metering orifices 99 preferably vary in diameter and in the illustrated embodiment, orifices of eight different sizes are provided.

A return line 97' is positioned in communication with return passage 97 in valve body 95 and is connected to a return port communicating with reservoir 75 in cylinder 70. Cylinder 70 is preferably provided with a fill port 75' to facilitate filling the system with hydraulic fluid. An accumulator 102 is connected through a line 103 to return line 97' and is preferably charged to a pressure of approximately 10 pounds per square inch.

Pressure transducers 105 and 110 are connected in fluid communication with the inlet passage 96 in valve body 95 through a passage 104. Pressure transducers 105 and 110 are of conventional design and deliver an output signal related to fluid pressure. As illustrated in FIG. 3 of the drawing, conductor B9 is connected to a 12 volt source and to transducers 105 and 110. Pressure transducers 105 and 110 are connected through a line B7 to ground. The output of pressure transducers 105 and 110 is delivered through conductors B15 and B19, respectively, to a microprocessor. As will be hereinafter more fully explained, signals from conductors B15 and B19 are used to indicate fluid pressure in opposite ends of cylinder 70.

Bearing sleeve 42, secured to the end of arm 41 is actuated by a user. A potentiometer 115 having a wheel 116 mounted thereon is positioned such that bearing 42 and wheel 116 are in rolling engagement. Thus, as arm 41 is rotated about pin 48 the output of potentiometer 115 will vary to indicate an angular position of arm 41. Potentiometer 115 is connected through a conductor B11 to a five volt source and through conductor B7 to ground. The output or wiper of potentiometer 115 is connected through conductor B13 to the microprocessor as will be hereinafter more fully explained.

Figure 9:
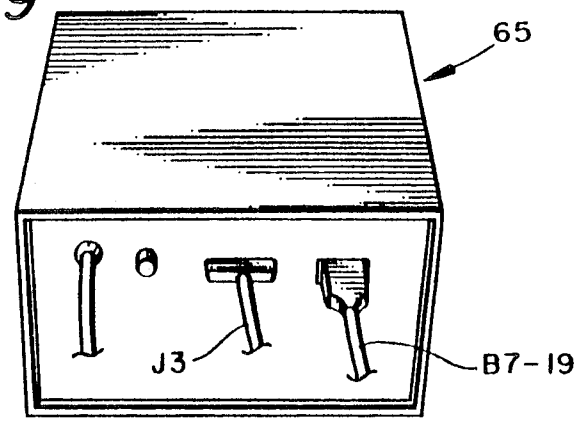
FIG. 9 is a perspective view showing the top and rear of the microprocessor housing.
Figure 10A:
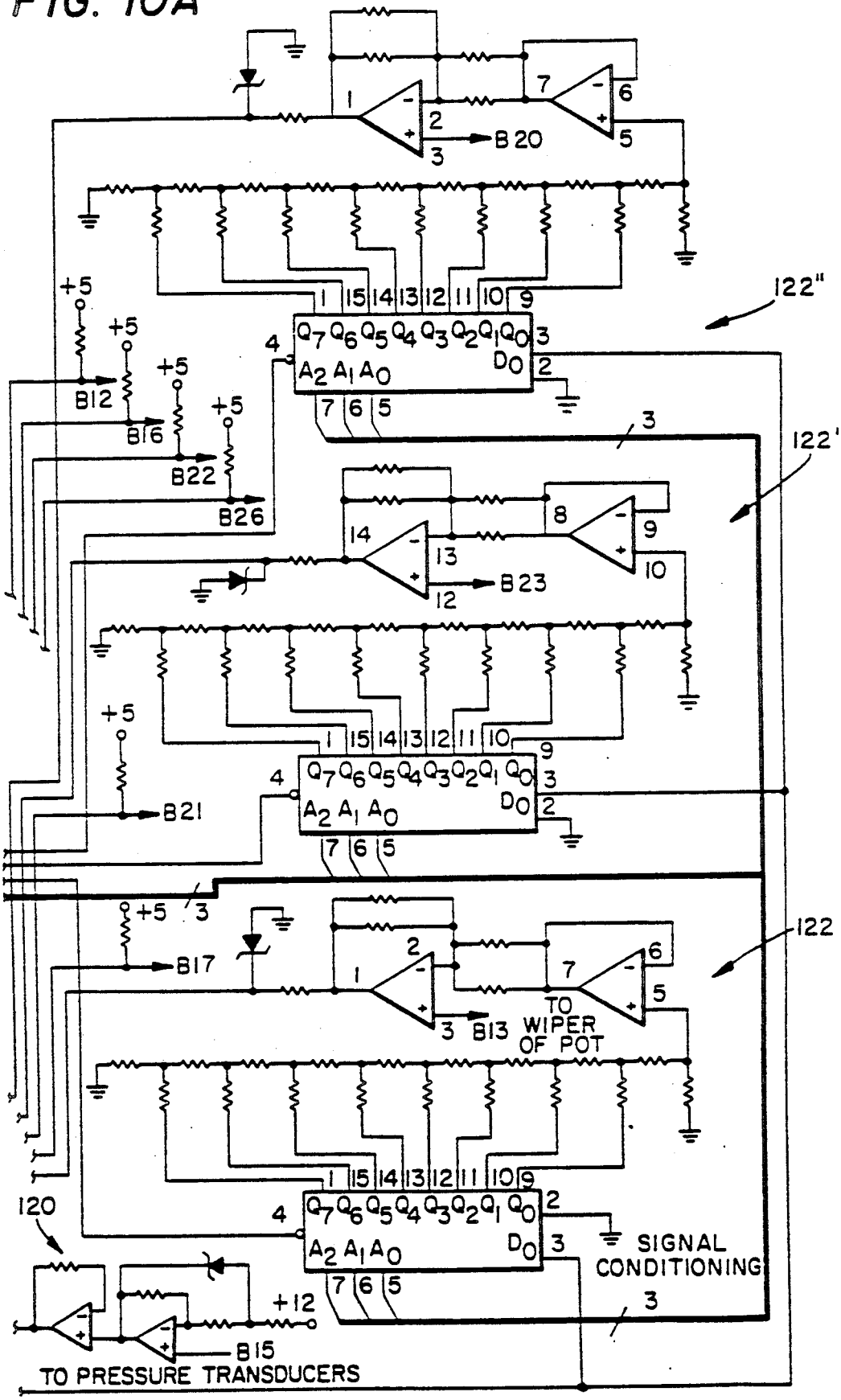
FIGS. 10A, 10B and 10C are wiring diagrams of the microprocessor circuit.
Figure 10B:
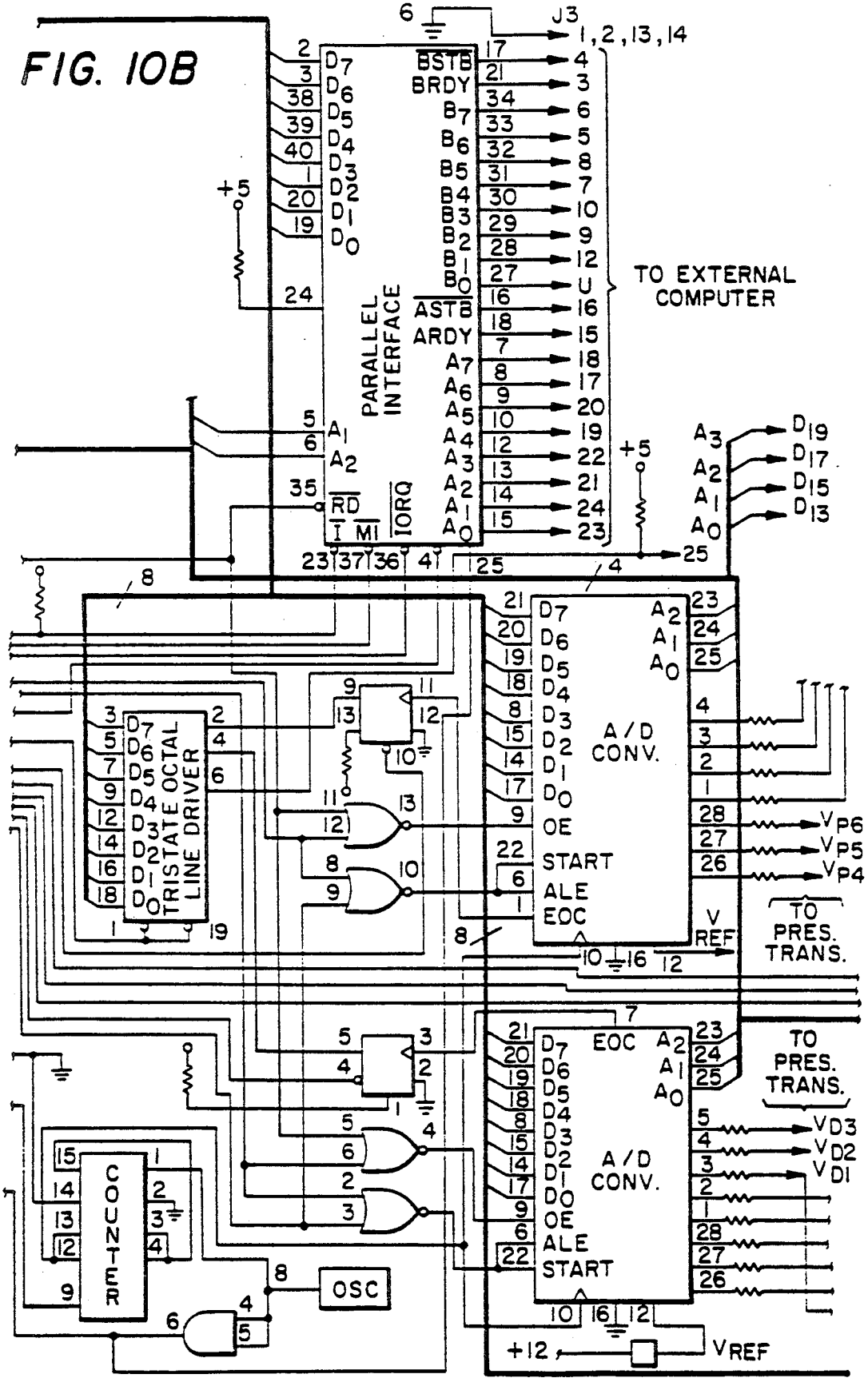
Figure 10C:
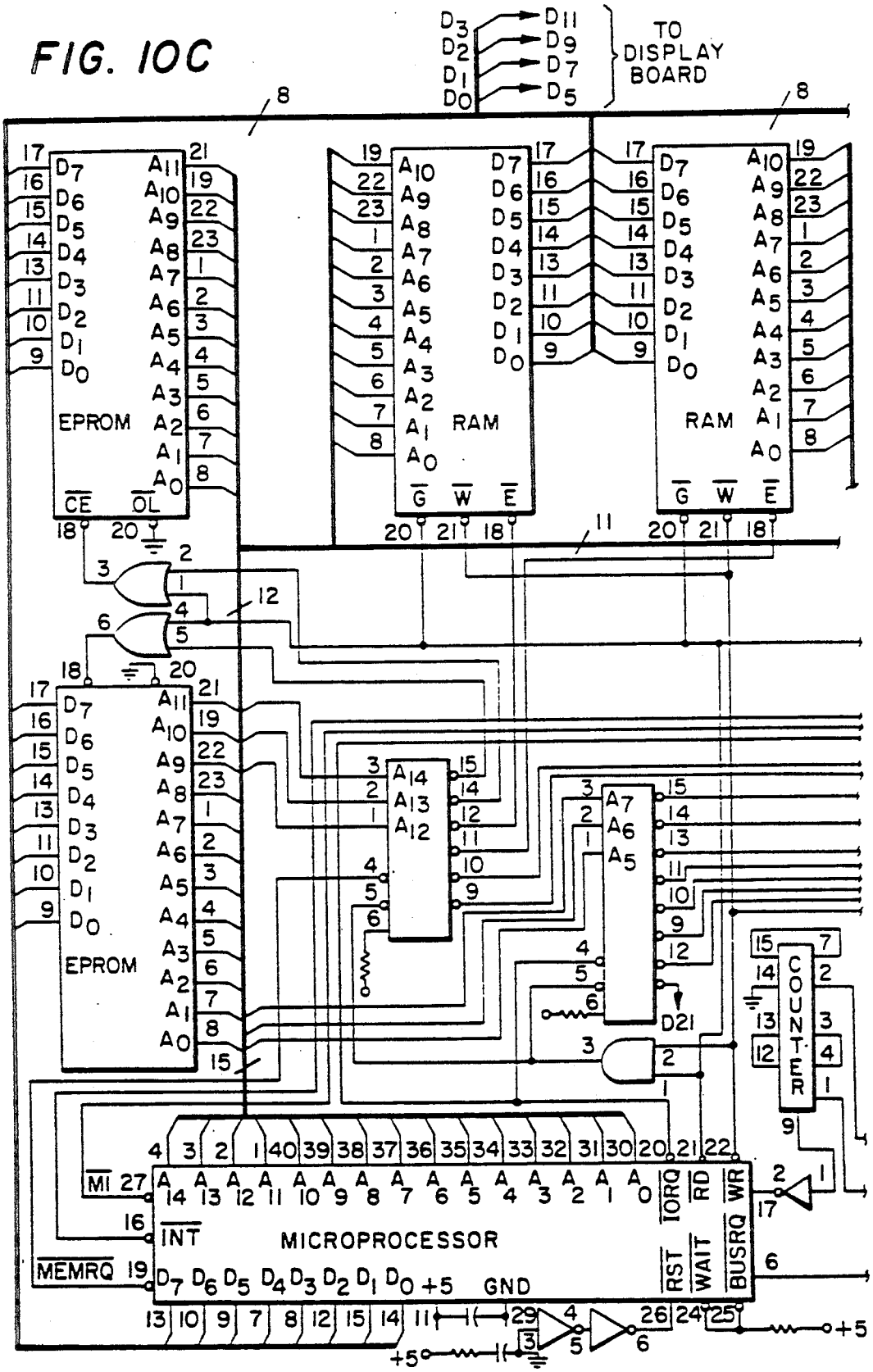

As best illustrated in FIGS. 8–14, signals from pressure transducers 105 and 110 and potentiometer 115 are delivered through a signal conditioning apparatus to a microprocessor to provide an output to a display board in microprocessor housing 65. Signals through conductors B15 and B19 are delivered through signal conditioning circuits 120 to an analog to digital converter designated ADC 0809 in FIG. 10. The signal from potentiometer 115 is delivered through conductor 113 to the analog is digital converter. In FIG. 10 of the drawing, one signal conditioning circuit 120 is diagrammatically illustrated. However, it will be readily apparent that a signal conditioning circuit 120 will be provided for each pressure source which is to be monitored. In FIG. 10 of the drawing, three signal conditioning circuits 122, 122' and 122'' are illustrated for accommodating three potentiometers 115 for processing data relating to the angle of more than one arm 41.

Figure 8:
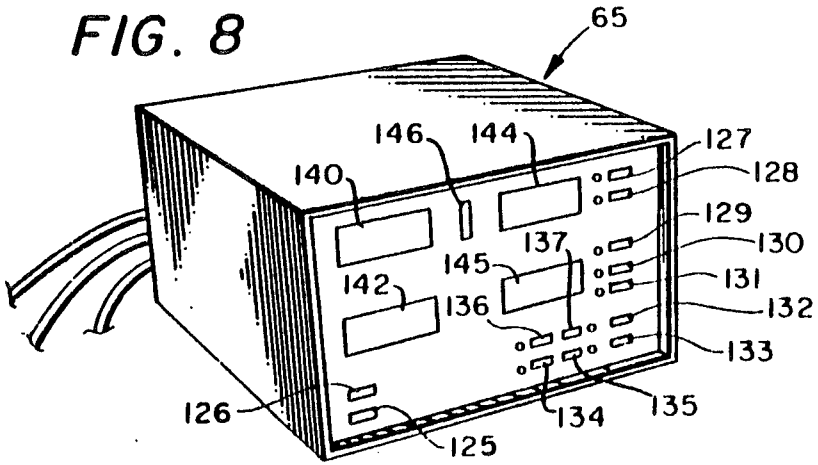
FIG. 8 is a perspective view of the housing for the microprocessor and associated switches to display desired information.
Figure 11A:
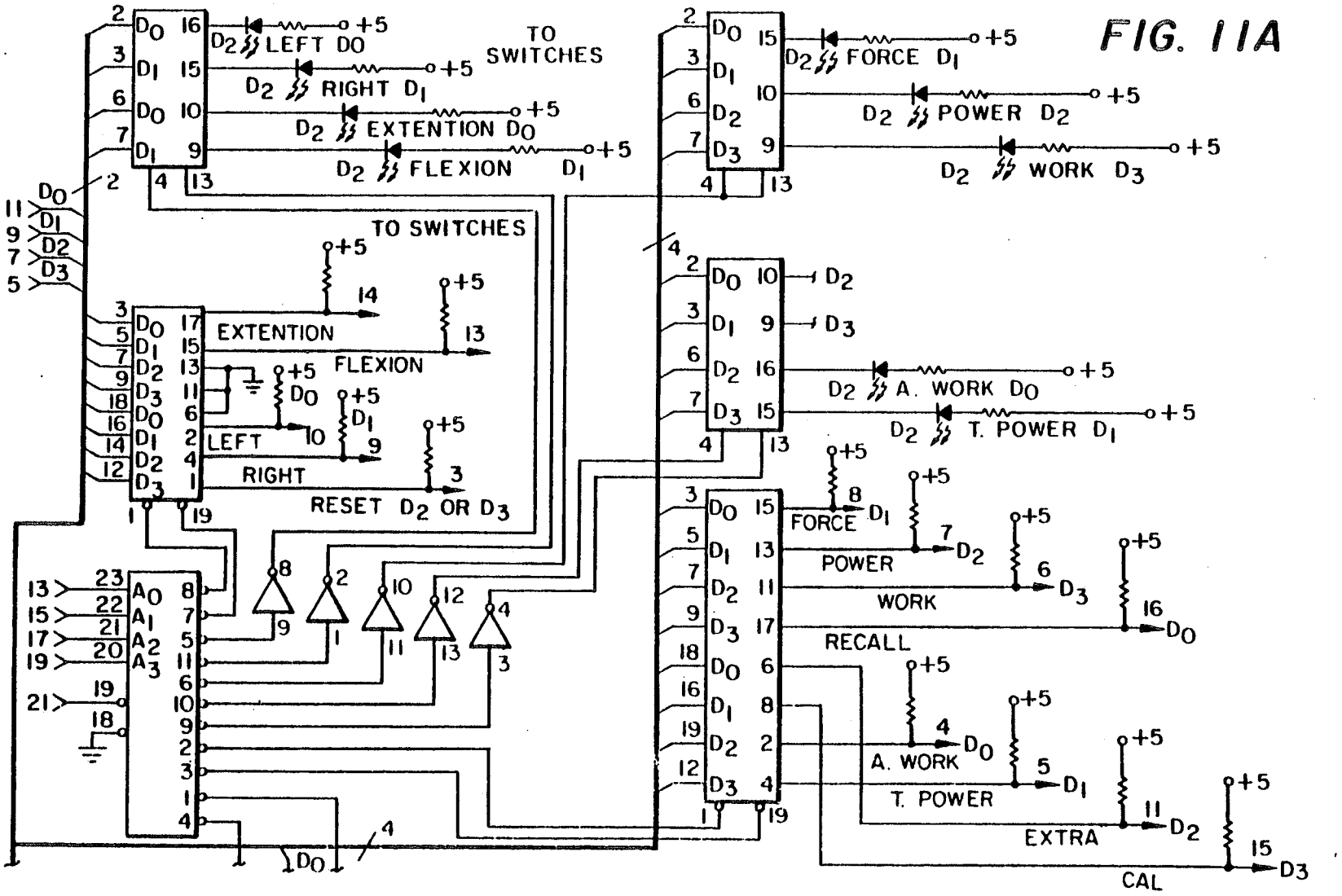
FIGS. 11A and 11B are wiring diagrams of the display board.
Figures 11B, 12, 13:
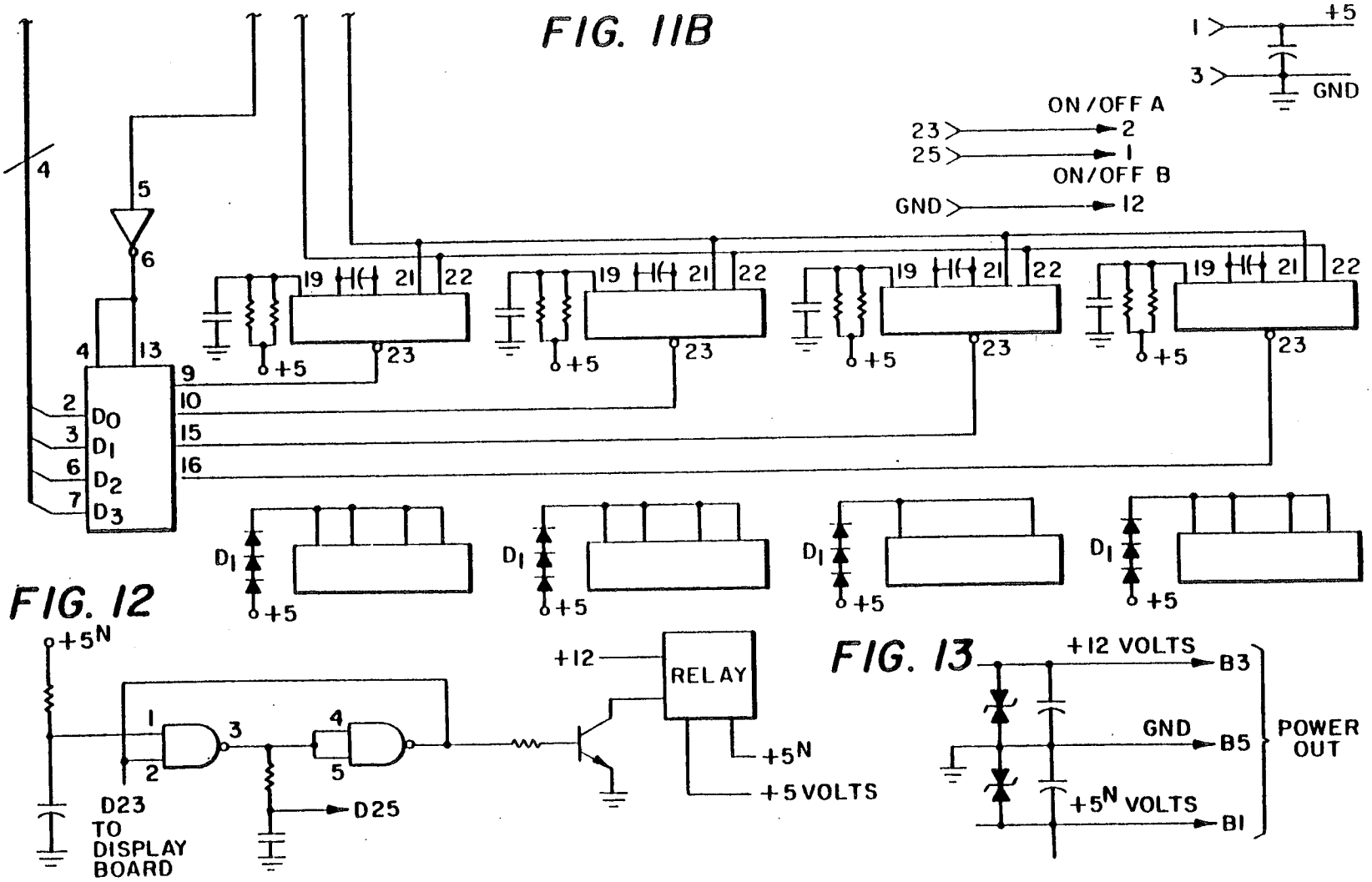
FIGS. 12 and 13 are more detailed wiring diagrams of the microprocessor housing.

Conductors designated "B" in FIG. 10 of the drawing, are connected to a back plate having a multipin connector and conductors labeled "D" communicate with a display board diagrammatically illustrated in FIG. 11A. Display board is connected through switches to light emitting diodes visible from the front of housing 65. As best illustrated in FIG. 8, the front of housing 65 is provided with an on-off switch 125 and a reset switch 126 on the left side of the housing and a column of switches 127–133 adjacent the right side of the housing along with switches 134–137 on a central portion of the face. Light emitting diodes 140, 142, 144 and 145 display data which is visible to the user and a diode is positioned adjacent each of the switches 125–137 to indicate which switch is in the active position.

Switch 125 is the power switch for turning the system "on and off" and switch 126 is a "reset" switch for resetting a timing cycle. "Elapsed time" is indicated in display 142 and the number of "repetitions", which would be movement of arm 41 from a lower position to an elevated position and back to the lowered position, are indicated by indicator 140.

Switches 127 and 129 would be labeled "work" on the face of the panel. If switch 129 were activated, a number in window 145 would indicate work done during the "previous repetition". When switch 127 is activated, the "accumulated" work since the system was reset will be indicated.

Switches 128 would be labeled "power" and when activated would display power exerted during the "previous repetition" in window 145 and the "accumulated" power in window 144. Switch 132 would be labeled "peak torque" and when switch 131 is activated, a number appearing in window 145 would indicate the maximum torque exerted on arm 41 during the previous repetition.

Switch 132 would be labeled "recall" and when pressed will cause data to be recalled to the system, the number of the particular repetition appearing in window 140 and the peak torque, power or work as selected by switches 129–130 to appear in window 145. Switch 133 is a calibration switch which is employed for initial calibration of the system to establish the angular extremes of a cycle or a single repetition.

Switches 136 and 137 would be labeled "right" and "left", respectively. When a user is seated on seat 34, the strength of his left leg would be indicated. When a user is seated in seat 32, the strength of his right leg would be indicated. A single arm 41 is employed to assure that any error appearing as a result of bearing friction, variation in diameter of cylinders or valve orifices will be eliminated from the system since both the right and left leg will be exercising the same actuating member. Light 145 is illuminated during the timed cycle and is turned on to indicate the beginning of the exercise.

The wiring diagrams of the circuit boards and display boards are illustrated in FIGS. 10–13 of the drawings, and are believed to be self explanatory. As illustrated in FIG. 9 of the drawing, the circuitry is connected through cable B7–19 to pressure transducers 105 and 110 and to angular potentiometer 115 as hereinbefore described. The system is connected through a cable labeled "J3" for inputting the data to a personal computer. Pin connector 13 from parallel interface 8420 is illustrated in FIG. 10B of the drawing.

When the data has been delivered to the personal computer, the data can be permanently stored on tapes or discs for observation at a later date. It will be readily apparent that the data may be illustrated graphically to assist the user or a therapist in determining the strength of each body member at each angle throughout a repetition of an exercise and to compare the data at each angle during each repetition at various times during a training or rehabilitation program. It will be appreciated that cylinder 70 and valve 95 associated therewith permit adjustment of resistance to extension or retraction of rod 85 independently and may be adjusted to provide substantially no resistance to movement in either direction while exerting substantial resistance in the other direction. Thus, the cylinder 70 can be made as a single acting cylinder upon movement of the piston in either direction or as a double acting cylinder by merely rotating knobs 100 and 101 on valve housing 95.

Having described the invention, it is claimed:

1. A leg exercising device comprising: a frame, a shaft secured to said frame; a pair of pedals; foot engaging means on said pedals adapted to exert face in opposite directions toward and away from each of said pedals as a result of movement of the foot of a user in opposite directions; first and second pedal arms secured to said pedals and pivotally secured to said shaft; a rocker arm pivotally secured to said frame; connector means secured between ends of said rocker arm and one of said pedals; and means secured between one of said pedal arms and said frame resisting pivotal movement of one of said pedal arms about said shaft in two directions.

2. A leg exercising device according to claim 1, said frame comprising: means positioning said pedal arm to pivot about a generally horizontal axis such that said arm extends substantially vertically for use for performing leg press exercises.

3. A leg exercising device according to claim 1, said valve means comprising: valve means having a plurality of metering orifices, each of said metering orifices being selectively positionable to control flow to and from the chamber in said double acting hydraulic cylinder.

4. A leg exercising device according to claim 1, said foot engaging means comprising: foot engaging plate means on said pedal arm; and foot engaging tow strap means secured to said plate, said toe strap being adapted to extend over the arch of the foot of a user when the sole of the foot of the user is resting o said plate.

5. A leg exercising device according to claim 1 said arm means comprising: first and second pedal arms; and with the addition of: a rocker arm pivotally secured to said frame; and connector means secured between ends of said rocker arm and one of said pedal arms.

6. A leg exercising device according to claim 5, said pedal arms comprising: elongated arms having ends; and wherein said connector means comprises: connector means secured to an end of said rocker arm and to a central portion of said elongated pedal arm intermediate opposite ends thereof.

7. An exercising device according to claim 5, said means resisting pivotal movement of one of said pedal arms about said shaft in two directions comprising: valve means having a plurality of metering orifices, each of said metering orifices being selectively positionable to control flow to and from the chamber in said double acting hydraulic cylinder; means connecting said valve means in communication with said chamber on opposite sides of said piston; and means securing said valve means to said frame at a location and in a position within the reach of a user while exercising a leg by exerting force by his foot to push and pull on said foot engaging means.

8. A leg exercising device according to claim 7, said connector means comprising: a pair of rigid connecting rods, each connecting rod having one end pivotally secured to an end of said rocker arm and a second end pivotally secured to one of said pedal arms.

9. A leg exercising device comprising: a frame; a shaft secured to said frame; a pair of pedals; foot engaging means on each of said pedals adapted to exert force in opposite direction toward and away from each of said pedals when the leg of a user is extended and retracted; first and second pedal arms secured to said pedals; means pivotally securing each of said pedal arms to said shaft; a rocker arm pivotally secured to said frame; connector means secured between ends of said rocker arm and one of said pedals; a double acting hydraulic cylinder having a chamber and a piston slidably disposed therein; an accumulating reservoir mounted in fluid communication with said chamber; valve means between said chamber and said reservoir for controlling flow of fluid to and from said chamber on opposite sides of said piston; and means adjacent said pedals within the each of a user standing on said pedals to permit independent adjustment of the magnitude of force resisting movement of each pedal.

10. A leg exercising device comprising: first and second tubular members, the second tubular member extending through the first tubular member forming an annulus between walls of the first and second tubular member; a piston in said second tubular member; spaced closure means adjacent opposite ends of said annulus forming a reservoir; a pair of piston rods secured to said piston, one of said piston rods extending through a passage in each closure means; first and second check valves, each check valve having a passage communicating with the reservoir and the inside of the second tubular member, said check valve being adapted to permit flow of fluid from the reservoir to the inside of the second tubular member and to block flow of fluid from each end of the second tubular member to the reservoir; first and second valve elements, each of said valve elements having a plurality of orifices of varying sizes positionable in communication with flow passages communicating with the inside of the second tubular member to independently and selectively adjust resistance to flow of fluid from said second tubular member to the reservoir; an accumulator in fluid communication with the reservoir, said accumulator being precharged to a specified pressure for maintaining fluid pressure in said reservoir; a plurality of spaced post means having first and second ends; first sill means secured to first ends of said post means; second sill means secured to second ends of said post means; support means secured to said post means between first and second ends of said post means; a pair of pedals; a shaft secured to said second sill means for rotatably supporting said pedals; means pivotally connecting said piston rod to one of said pedals; and means movably secured to said support means for connecting a first of said pedals for transmitting force to a second of said pedals which is opposite in direction and of less magnitude than force applied to the first of said pedals.

11. A leg exercising device according to claim 10, said means connecting said pedal arms comprising: a rigid rocker arm; and rigid connecting rods secured between ends of said rocker arm and one of said pedal arms.

12. A leg exercise device comprising: a frame; a plurality of spaced post means having first and second ends; first sill means secured to first ends of said post means; second sill means secured to second ends of said post means; support means secured to said post means between first and second ends of said post means; first and second pedal arms to said second sill means; a rocker arm pivotally secured to said support means; connector means secured between each end of said rocker arm and one of said pedals; double acting hydraulic resistance means secured between said rocker arm and said support means; and pedal means secured to each of said first and second pedal arms, said pedal means being adapted to engage feet of a user to permit a first foot of the user to push on said first pedal means to move said first pedal means in a first direction while pulling on said second pedal means with his other foot to move said second pedal means in a second direction to simultaneously perform extensive exercise on one leg and flexure exercise on the other leg, said resistance means being adapted to exert different forces resisting movement of said first and second pedal arms such that the magnitude of force applied to said pedal means to push said first pedal arm from a first position to a second position is different from the force required to move said first pedal from the second position to the first position.

13. A leg exercise device comprising: a frame; a plurality of spaced post means having first and second ends; first sill means secured to first ends of said post means; support means secured to said post means between first and second ends of said post means; first and second pedal arms; means pivotally securing said first and second pedal arms to said second sill means; a rocker arm pivotally secured to said support means; connector means secured between each end of said rocker arm and one of said pedals; double acting hydraulic resistance means secured between said rocker arm and said support means; pedal means secured to each of said first and second pedal arms, said pedal means being adapted to engage feet of a user to permit a first foot of the user to push on said first pedal means to move said first pedal means in a first direction while pulling on said second pedal means with high other foot to move said second pedal means in a second direction to simul;taneously perform extensive exercise on one leg and flexure exercise on the other leg; and first and second valve means secured to said frame within reach of a person standing on said pedal means to permit independent adjustment of force required to move said first pedal arm in opposite directions.

* * * * *